United States Patent [19]

Richardson

[11] 4,225,637

[45] Sep. 30, 1980

[54] PROCESS FOR WOOD TREATMENT

[75] Inventor: Neil G. Richardson, Montreal, Canada

[73] Assignee: Domtar Inc., Montreal, Canada

[21] Appl. No.: 16,913

[22] Filed: Mar. 2, 1979

[51] Int. Cl.[2] ..... B05D 3/00; B05D 3/12; B05D 3/04

[52] U.S. Cl. ..... 427/297; 427/335; 427/345; 427/351; 427/440; 134/10; 134/42

[58] Field of Search ..... 427/254, 297, 333, 343, 427/335, 351, 440, 345

[56] References Cited

U.S. PATENT DOCUMENTS

| | | | |
|---|---|---|---|
| 675,826 | 6/1901 | Geisler | 427/297 X |
| 1,680,529 | 8/1928 | Richter et al. | 427/297 |
| 3,464,782 | 9/1969 | Ricard et al. | 427/254 |
| 3,537,887 | 11/1970 | Blohm | 427/254 |
| 3,922,397 | 11/1975 | Bagmiller | 427/254 |

*Primary Examiner*—Michael R. Lusignan
*Attorney, Agent, or Firm*—C. A. Rowley

[57] ABSTRACT

The present invention provides a process for the treatment of wood material impregnated with an aqueous ammoniacal solution of water-insoluble treating chemical and having deposits of treating chemical on its surface. The process comprises submerging the impregnated wood material in the ammoniacal solution, separating the wood material from the solution and maintaining it in a moist, ammoniacal atmosphere until the wood surface is substantially free of liquid. In another aspect, this invention relates to a process for producing wood material treated with the ammoniacal solution, where the product has a clean surface.

11 Claims, No Drawings

PROCESS FOR WOOD TREATMENT

FIELD OF THE INVENTION

The present invention relates to a process for the treatment of wood material impregnated with an ammoniacal solution of a water insoluble treating chemical to produce a treated wood material with a "clean" surface.

BACKGROUND OF THE INVENTION

A common procedure for the treatment of wood material such as plywood, lumber or the like with an ammoniacal solution of water-insoluble treating chemicals (such as those derived from copper, zinc or arsenic) is to treat the wood material with the ammoniacal solution under pressure in a treating vessel, for a time sufficient to impregnate the wood material with a requisite amount of the treating solution, release the pressure, remove the treating solution from the vessel and withdraw the impregnated wood therefrom. The impregnated wood is then left in open air to permit the gradual loss of ammonia from the wood material causing a deposition of the treating chemical therein. This is generally followed by a drying cycle.

This procedure may result in the surface of the wood material being marred by unsightly blotches and stains due to deposits of the treating chemical. These deposits are not only objectionable on aesthetic grounds, in that they detract from the appearance of the wood; but also because they represent a loss of chemical since such chemicals residing on the surface can be subject to erosion and do little to protect the wood.

It is believed that this problem is related to the loss of ammonia from pools of the solution which remain on the surface of the wood after impregnation. Additional treating solution is brought to the surface as a result of "kickback", a phenomenon whereby the air pressure within the wood cells equilibrates itself with the ambient pressure, forcing out some of the solution close to the surface. The wood surface is tilted and the solution is permitted to drain freely from the wood material during and immediately following the impregnation step.

Good practice additionally calls for a brief reduction of pressure immediately following the removal of the excess treating solution from the impregnation vessel in an attempt to accelerate the equilibration of the pressure inside and outside the wood while permitting this expelled liquid to drop off the wood within the vessel. Despite these preventive measures, the surface of the resultant product is often stained, spotted or streaked with deposits of the treating chemical.

The term "clean" is intended to mean a condition where the surface of the wood appears like colored wood and shows substantially no evidence of adhering solid, dust, etc. To an experienced eye, the difference between wood material having a "dirty" surface as described above and that having a "clean" surface will be quite pronounced.

It is the object of the present invention to provide a means of providing an impregnated wood material with a clean surface.

A method for preventing stains on the surface of wood material impregnated with ammoniacal preservative solutions, by maintaining the impregnated wood, after release of pressure and withdrawal of the impregnating liquid from the treating vessel in an atmosphere of carbon dioxide gas, is disclosed in U.S. Pat. No. 4,008,342, issued Feb. 15, 1977 to Domtar Limited. This technique is not wholly effective if significant kickback occurs after treatment.

BRIEF DESCRIPTION OF THE INVENTION

In one aspect, the present invention relates to a process for providing impregnated wood material with a clean surface, the wood material having been pressure impregnated with an aqueous ammoniacal liquor containing an ammoniacal compound and a water-insoluble treating chemical and subsequently at least partially dried, thereby substantially equilibrating pressure within the wood material and causing deposits of the treating chemical on surface of the wood material, the process comprising: submerging the wood material having the deposits on surface thereof in an aqueous ammoniacal treating solution having substantially the same concentration of the ammoniacal compound and the treating chemical as the aqueous ammoniacal liquor, dissolving at least a portion of the deposits in the solution, separating the ammoniacal solution from the wood material thereby to leave the wood material with a wetted surface, maintaining the wetted surface in an atmosphere containing ammonia gas until the surface is substantially free of the solution and reusing the separated ammoniacal treating solution.

In another aspect, the present invention relates to a process of treating wood material comprising pressure impregnating the wood material with an aqueous ammoniacal solution having a water-insoluble treating chemical dissolved therein, thereby to obtain a pressure impregnated wood material with treating chemical deposits on the surface thereof, and including the steps of contacting the impregnated wood material with the ammoniacal solution, and dissolving at least a portion of the deposits on the surface, thereby to obtain a pressure impregnated wood material with a clean surface.

DETAILED DESCRIPTION OF THE INVENTION

As noted earlier, wood material such as plywood, lumber or the like, is treated with an aqueous ammoniacal solution of a water insoluble treating chemical, by placing the wood material in a pressure vessel, optionally subjecting it to a sub-atmospheric pressure before introducing the treating solution in a quantity sufficient to submerge the wood, maintaining an elevated pressure in the vessel for a time sufficient to impregnate the wood with a requisite amount of the solution, releasing the pressure and removing excess treating solution from the vessel before withdrawing the impregnated wood material. This is followed by the step of drying the wood material either in a kiln or in open air to a desired moisture content.

The appearance of the dried wood material is often marred by blotches and stains due to deposits of treating chemical. Before further treatment of the wood to eliminate such blotches, the pressure within the wood pores must have substantially reached equilibrium with the ambient pressure, i.e. kickback must have substantially terminated. The process according to the present invention provides the further step of contacting such equilibrated, stained wood material with the ammoniacal solution. The ammoniacal and treating chemical concentrations in this solution should not differ substantially from that of the impregnating solution, in order to avoid or minimize treating chemical depletion in the wood layers immediately adjacent the surface. Normally the solution will be applied by submerging the impregnated, blotched wood material in the ammoniacal solution, however other contacting techniques such as spraying, etc. can be envisaged. Irrespective of the contacting technique employed, the solution should thoroughly wet the surface and be sufficient to dissolve the deposits. The time for dissolution, will normally be between ½ and 4 hours and will be inversely related to the temperature of the contacting solution and its ammoniacal concentration but will primarily be determined by the thickness and amount of the deposits. The temperature will normally lie between 10° and 50° C., preferably between 35° and 45° C., and will probably be carried out at the elevated temperatures at which impregnation is usually carried out. The solution in excess of that required to wet the surface is removed from contact with the wood material and the wood material is kept in an ammoniacal atmosphere to prevent deposition of the treating chemical on the wood surface until the surface is substantially free of the solution. It is desirable to subject the wood material to a brief reduction in pressure following the withdrawal of the contacting liquid, to remove any residual liquid which may subsequently seep out and leave behind deposits on the wood surface. Following the optional step of pressure reduction, the wood material is maintained as mentioned above, in an ammoniacal atmosphere to prevent the loss of ammonia from the residual layer of solution on the surface of the wood, thereby inhibiting reprecipitation of the wood treating chemical from the liquid layer prior to its disappearance from the surface, either by absorption into the wood or by dripping off the wood. When the wood surface is substantially free of liquid, a state discernible by the substantial absence of pools or films of free liquid on the wood surface; the wood material may be withdrawn from the contacting vessel and dried in the usual way.

In the preferred embodiment, the present process will be a step in an overall process for the production of clean, treated wood material. In addition to the attractiveness inherent in providing a process, the end result of which is clean, treated wood material; another feature of such an operation is the reincorporation of the deposited treating chemical dirtying the wood into the ammoniacal solution (or into the wood) thereby minimizing treating chemical wastage by permitting its reuse in subsequent impregnations.

Typically, such a process would comprise the steps of pressure impregnating the wood material with a requisite amount of the ammoniacal solution, separating the impregnated wood material from the excess solution, partially drying the wood material; preferably to a dryness where the wood fibre lumen (i.e. cavities bounded by the wood cell walls) are substantially devoid of water, i.e. about 30% moisture content, so as to permit rapid reabsorption of the liquid which subsequently rewets the surface. During this partial drying deposits of treating chemical form on the surface and the pressure in the wood cells is simultaneously permitted to equilibrate with the ambient pressure, thereby terminating kickback before any further treatment. This is followed by immersing the partially dried wood material in the ammoniacal solution and dissolving any deposits of the treating chemical on the surface of the wood material, separating the ammoniacal solution from contact with the wood, which leaves the surface of the wood wetted leaving the wood material in an ammoniacal atmosphere to maintain the treating chemical in the solution wetting the wood surface until the surface is substantially free of the ammoniacal treating solution. The ammoniacal solution removed from contact with the rewetted wood material is recycled to the impregnation step for reuse in impregnating another batch of wood material after adjusting the treating chemical concentration and solution volume.

The following examples illustrate some embodiments of the present invention.

EXAMPLE 1

Western hemlock and Douglas fir lumber impregnated in the standard fashion (described earlier) with a 3% solution of copper arsenate in 3% aqueous ammonium hydroxide (normally known as "Chemonite"-(TM)) was kiln dried for about 5 days to a moisture content of about 19%. This resulted in a product having deposits of copper-arsenic compounds on the surface.

This wood material was charged to a treating vessel where it was submerged in a contacting liquid of a Chemonite (TM) solution at about 38° C. for 1½ hour. This solution was equivalent to that used to impregnate the wood earlier. The contacting liquid was then pumped out of the contacting cylinder and the wood material subjected to a vacuum equivalent to 23" (mercury) for 1½ hour. The vacuum was broken and the wood material was permitted to drain for 2 hours in the contacting vessel in the ammoniacal atmosphere.

The treated lumber was then withdrawn from the vessel and allowed to dry. The dried wood material had a clean surface.

EXAMPLE 2

Impregnated lumber, similar to that employed in the previous example was air dried for three days and found to be contaminated with surface deposits. It was then immersed in a Chemonite (TM) solution at about 38° C. for 1 hour. Following the withdrawal of the solution from the vessel, the lumber was allowed to drain in the vessel for 1½ hour in the ammoniacal atmosphere. The product was withdrawn from the vessel and was kiln dried following a brief period (3–5 hours) of seasoning in open air. The resultant was a clean, treated wood material.

EXAMPLE 3

Lumber similar to that used in the previous examples was impregnated, dried and which had surface deposits of treating chemical; was charged to a pressure vessel, subject to an initial vacuum of 22" (mercury) for ½ hour, the Chemonite (TM) solution was permitted to fill the cylinder, the vacuum broken, and the lumber was left in the solution at 40° C. for 1 hour. Following withdrawal of the solution from the vessel, the lumber was left in the vessel and allowed to drain for 1½ hour in an ammoniacal atmosphere, before it was withdrawn. This procedure resulted in a clean product which was first briefly (3–5 hours) subjected to an air seasoning before commencing kiln drying. The resultant kiln dried lumber had a clean surface.

EXAMPLE 4

Kiln dried western hemlock lumber was impregnated with Chemonite (TM), in substantially the same fashion as the full cell process described above. This was kiln dried for 5 days, to a moisture content of 19%. The resultant wood product had deposits of the copper arsenic compound on its surface.

The lumber was then submerged in a Chemonite (TM) solution at about 40° C. for about 1½ hour. The liquid was pumped out of the contacting vessel and the wood material permitted to drain in the vessel for 1½ hour. After this drainage period, the lumber was removed from the cylinder, and air dried for a day. The resultant was a clean, treated wood product.

The description and examples provided above are for the purpose of providing a complete disclosure of the invention, and alterations and modifications within the scope of the appended claims, may occur to those skilled in the art.

The embodiments of the invention in which an exclusive property or privilege is claimed are defined as follows:

1. A process for cleaning wood material impregnated with an aqueous ammoniacal liquor containing in solution a water insoluble treating chemical, and having deposits of said treating chemical on surfaces thereof; said process comprising submerging said wood material in an aqueous ammoniacal treating solution, dissolving a significant portion of said deposits in said solution, separating said ammoniacal solution from said wood material thereby to leave said surfaces wetted with said solution, maintaining said wetted surfaces in an atmosphere containing ammonia gas until said surfaces are substantially free of said solution, and reusing said separated solution.

2. A process for the treatment of wood material comprising pressure impregnating a charge of wood material with an aqueous ammoniacal solution containing a water-insoluble treating chemical in solution, separating said impregnated wood material from an excess of said solution, at least partially drying said wood material thereby substantially equilibrating pressure within said wood material and producing deposits of said treating chemical on surfaces of said wood material, resubmerging said at least partially dried wood material in said ammoniacal solution, dissolving a significant portion of said deposits in said solution, again separating said solution containing substantially all of said significant portion said deposits from said wood material and leaving said surfaces wetted with said solution, maintaining said wetted surfaces in an atmosphere containing ammonia gas thereby to maintain said treating chemical in solution in said solution wetting said surfaces until said surfaces are substantially free of said solution, and reusing said separated solution containing said deposits to impregnate a further charge of wood material.

3. Process as defined in claim 1 or 2 where said ammoniacal treating solution contains dissolved herein a member chosen from the group consisting essentially of copper, zinc or arsenic.

4. Process as defined in claim 1, or 2 where said ammoniacal treating solution rewetting said surface of said partially dried impregnated wood material is at a temperature between 10° and 50° C.

5. Process as defined in claim 1, or 2 where said wood material is subjected to a subatmospheric pressure following said separation of said treating solution from said wood material.

6. Process as defined in claim 1 or 2 where said immersion is for a period of between about ½ and 4 hours.

7. Process as defined in claim 1 or 2 where substantially all said deposits on said surface of said wood material are dissolved by said ammoniacal treating solution.

8. Process as defined in claim 1, comprising the additional step of drying said wood material after said wetted surface is substantially free of said solution.

9. Process as defined in claim 2 comprising the additional step of drying said wood material after said rewetted surface is substantially free of said solution.

10. Process as defined in claim 8 or 9, where said drying is air drying.

11. Process as defined in claim 8 or 9, where said drying is carried out in a kiln.

* * * * *